US006016728A

United States Patent [19]

Bohl

[11] Patent Number: 6,016,728

[45] Date of Patent: Jan. 25, 2000

[54] COMPACT MULTI-PURPOSE HAND TOOL

[76] Inventor: Russell D. Bohl, 7382 Upham Ct., Arvada, Colo. 80003

[21] Appl. No.: 09/073,800

[22] Filed: May 6, 1998

[51] Int. Cl.[7] ..... B25F 1/00

[52] U.S. Cl. ..... 81/437; 81/438; 7/139; 7/165

[58] Field of Search ..... 81/437, 438, 439, 81/436, 177.4, 489; 7/139, 165

[56] References Cited

U.S. PATENT DOCUMENTS

| | | | |
|---|---|---|---|
| 686,424 | 11/1901 | Smith . | |
| 853,558 | 5/1907 | Madsen | 81/437 |
| 1,558,036 | 10/1925 | Moffitt | 81/437 |
| 1,866,426 | 6/1932 | Siegrist . | |
| 3,114,401 | 12/1963 | Johnson | 81/438 |
| 3,370,307 | 2/1968 | Beeks . | |
| 4,848,197 | 7/1989 | Kikel | 81/438 |
| 4,960,016 | 10/1990 | Seals . | |
| 4,967,435 | 11/1990 | Seals . | |
| 5,174,178 | 12/1992 | Disston, Jr. . | |
| 5,251,353 | 10/1993 | Lin . | |
| 5,280,659 | 1/1994 | Park . | |
| 5,305,667 | 4/1994 | Caballero . | |
| 5,345,636 | 9/1994 | Lamons . | |
| 5,432,968 | 7/1995 | Beck . | |
| 5,533,429 | 7/1996 | Kozak . | |
| 5,606,758 | 3/1997 | Tung . | |
| 5,632,056 | 5/1997 | Hsiao . | |
| 5,651,647 | 7/1997 | Ray | 81/439 |

OTHER PUBLICATIONS

Advertisment For Multi–Ratchet Wrench No. 65518 7–IN–1.

*Primary Examiner*—Eileen P. Morgan
*Assistant Examiner*—Joni B. Danganan
*Attorney, Agent, or Firm*—Sheridan Ross P.C.

[57] ABSTRACT

The multi-purpose tool includes many useful features. The tool has an adjustable wrench, such as a crescent wrench, on one end and a hollow bore for receiving a number of different tools on the other. The tools that are received in the bore are positioned on opposing ends of elongated members and are reversible in the bore to expose the desired tool. The tool can include an extension that fits over the exposed tool (which thereby acts as a connecting piece) to provide additional capabilities.

19 Claims, 5 Drawing Sheets

COMPACT MULTI-PURPOSE HAND TOOL

FIELD OF THE INVENTION

The present invention is directed generally to hand tools and specifically to multi-purpose hand tools.

BACKGROUND OF THE INVENTION

Multi-purpose tools are used by both professionals and amateurs to perform a variety of tasks. Multi-purpose tools typically have a body that either contains or engages a variety of tools, such as screwdrivers, knives, wrenches, sockets, and the like.

In designing a multi-purpose tool, there are a number of important considerations. First, the multi-purpose tool should be relatively compact and lightweight. The multi-purpose tool must be easily transportable by the user. Second, the multi-purpose tool should be versatile and permit the user to choose from a variety of commonly used tools. Commonly used tools include screwdrivers and wrenches. Third, the multi-purpose tool should have a simple design and be relatively easy to use. It is important to use a minimal number of parts to provide the desired tools. Finally, the multi-purpose tool should be contoured to fit comfortably in the hand of the user.

SUMMARY OF THE INVENTION

These and other design considerations are addressed by the multi-purpose tool of the present invention. In one embodiment, the multi-purpose tool includes a handle having a distal end having spaced-apart surfaces for gripping objects, such as nuts and bolt heads, and a proximal end having a hollow bore for removably engaging an elongated member that provides one or more tools for the user. To provide ease of use, the longitudinal axis of the handle (and of the multi-purpose tool) can be substantially aligned with the longitudinal axis of the elongated member.

The elongated member can have a tool on each of its opposing ends to provide versatility. The tools on each of the opposing ends can be the same type of tool but have different sizes or a different type of tool, as desired. The tool is a commonly used tool such as a screwdriver having a straight-blade head (e.g., a regular screwdriver), a cross head (e.g., a "PHILLIPS" screwdriver manufactured by the Phillips Screw Company), a star-shaped head (e.g., a "TORX" screwdriver) and a hexagonal wrench (e.g., an "ALLEN" wrench). The multi-purpose tool can include a variety of interchangeable elongated members having different types and sizes of tools for even more versatility.

Preferably, the spaced-apart surfaces are substantially parallel to one another. At least one of the spaced-apart surfaces is movably mounted on the distal end of the handle to permit the distance between the surfaces to be varied by the user (e.g., an adjustable wrench such as a "CRESCENT" wrench) for removing threaded fasteners such as nuts, screws, and bolts.

The handle can be of any desired shape with a substantially cylindrical shape being most preferred. The substantially cylindrical shape fits comfortably in the hands of the user.

The elongated member(s) can have a button for engaging a recess in the bore to lock the elongated member in position in the bore. The button is movably mounted on the elongated member with a spring contacting a bottom end of the button and a rounded (i.e., spherical) surface of the button projecting from a surface of the elongated member to engage the recess. The spring permits the button to move upwardly and downwardly when the member is inserted into or removed from the bore. For ease of use, a button can be located at each of the opposing ends of the elongated member.

The tool can include one or more extensions, with the proximal end of each extension having a bore for receiving the portion of the elongated member protruding from the handle bore. The extension can have a tool, such as a socket or nut driver, on the distal end for added versatility. The sockets can be either metric or standard sizes. An adaptor can fit in the socket (which is typically hexagonal in configuration) to provide a rectangular head for engaging a plurality of other sockets.

The extension can be removed from the handle and used independently as a tool. For example, the extension can have a screwdriver on the end of the elongated member that protrudes from the extension. The extension thereby provides a handle for the screwdriver.

The multi-purpose hand tool has a number of advantages. The multi-purpose hand tool is compact and lightweight. The multi-purpose tool can easily fit within a relatively small pouch and be carried by users almost anywhere. The multi-purpose tool is of a simple design and is easy to use. The elongated members are interchangeable in the bore, and each elongated member can be reversed in the bore to provide additional tools for the user. The extensions simply snap onto the protruding end of the elongated member to provide further tools for the user.

DETAILED DESCRIPTION

Figure 1:
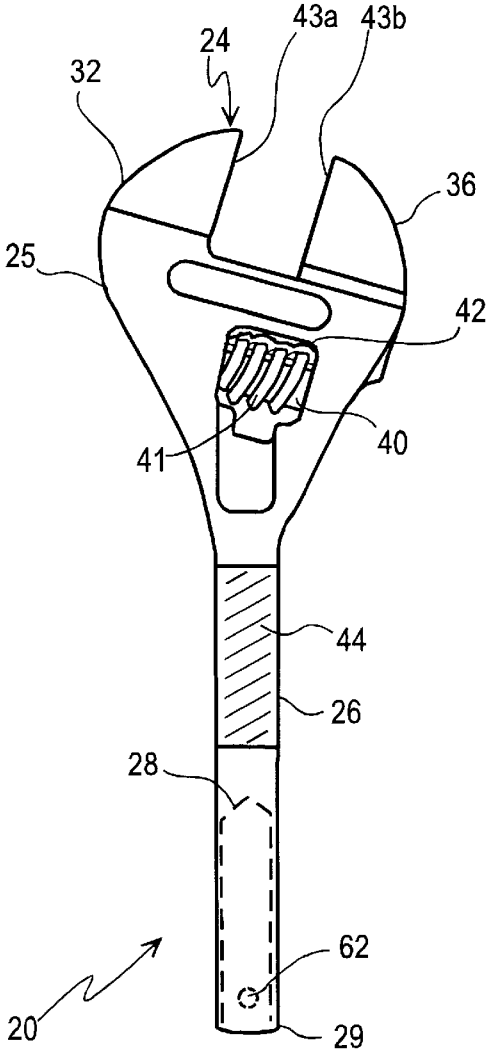
FIG. 1 is a top view of an adjustable crescent wrench according to the present invention.

Referring to FIG. 1, a compact multi-purpose hand tool 20 according to a first embodiment of the present invention is illustrated. The multi-purpose hand tool 20 includes a crescent wrench 24 on the distal end 25 and a handle 26 having a hollow bore 28 on the proximal end 29. The crescent wrench 24 includes a fixed upper jaw 32, an adjustable lower jaw 36, and a rotatable, threaded adjustment device 40 to move the adjustable lower jaw 36 inwardly and outwardly relative to the fixed upper jaw 32 by engaging the threads 41 on the device 40 with a serrated portion 42 of the lower jaw. In this manner, the distance separating the jaws can be varied as desired by the user to engage objects of differing sizes. The spaced-apart surfaces 43*a,b* on the jaws are substantially parallel to one another to grip objects such as nuts and bolts. As will be appreciated, a variety of other head configurations can be used instead of a crescent wrench. For example, the distal end 25 can be configured as a channel lock, an adjustable closed-mouthed wrench, or an unadjustable open- or closed-mouthed wrench.

The handle 26 has a knurled section 44 to provide more grip for turning the hand tool 20 with the fingers to provide greater speed for installing and removing fasteners. Although a cylindrical handle is depicted in the Figures, the handle can have a number of different shapes (eggs, rectangular or hexangular) depending upon the needs of the user.

Figures 2, 3, 4, 5, 6:
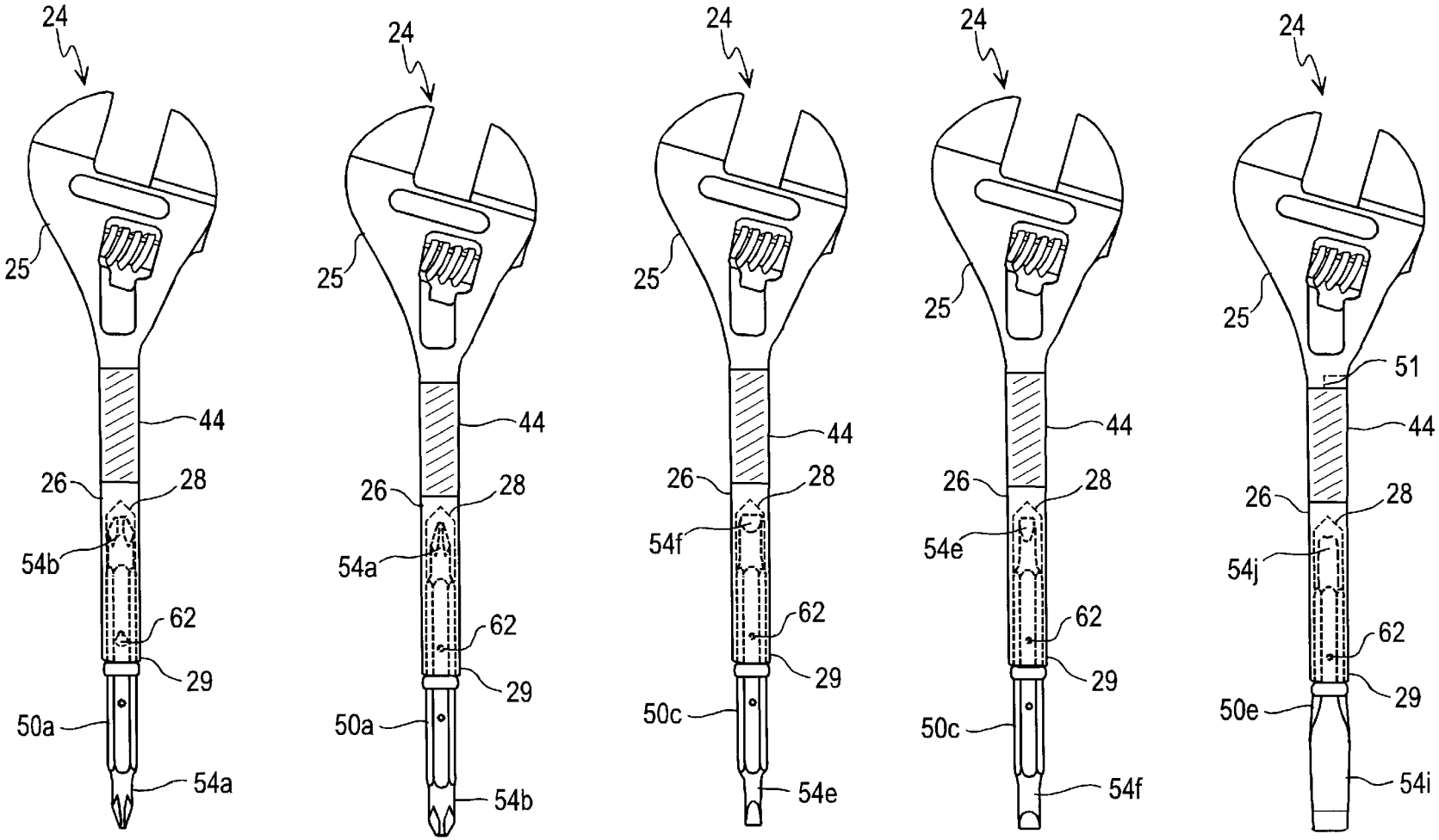
FIGS. 2–6 are top views of the adjustable crescent wrench attached to a variety of elongated members.

Referring to FIGS. 2–6, the tool 20 can be connected to a variety of interchangeable elongated members 50*a–e*. The elongated members 50*a–e* each have a different tool 54*a–j* on the opposing ends of the elongated members separated by a stop 52 to prevent the elongated member from extending too far into the bore 28. The elongated members can be reversed in the hollow bore 28 to expose either end (and therefore either tool) for application by the user. By way of example, FIGS. 2 and 3 depict the same elongated member engaged with the bore with the position of the elongated member in the bore being reversed. This is also true for the elongated member in FIGS. 4 and 5. Although the tools depicted in the Figures are only cross-head and straight-blade screwdrivers, other tools such as a star-shaped headed screwdriver and a hexagonal wrench can also be used. The widened profile of the crescent wrench 24 is used for additional leverage in turning the exposed tool on the elongated member.

The elongated member can have any desired shape so long as the member is firmly received in the bore of the handle. A preferred shape is hexagonal or rectangular, with hexagonal being most preferred. As will be appreciated, the internal shape of the bore is the same as the shape of the member. Thus, if the member is hexagonal, the bore is also hexagonal.

Figure 7:
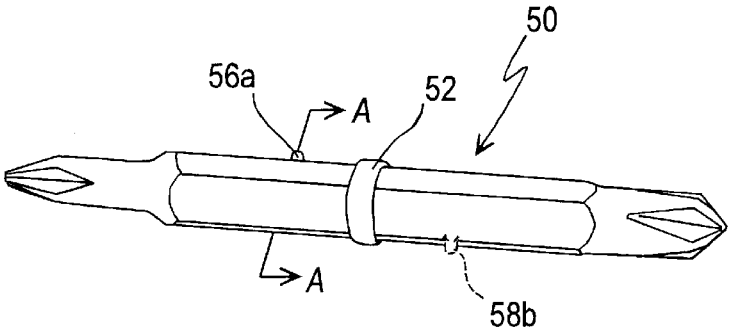
FIG. 7 is a top view of an elongated member.
Figure 8:
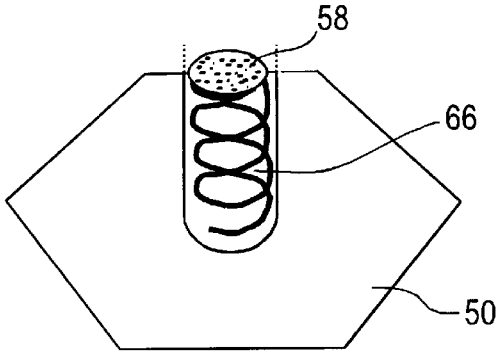
FIG. 8 is a cross-sectional view taken along line A—A of FIG. 7 of the button assembly.

With reference to FIGS. 7–8, each of the elongated members has a pair of spring loaded buttons 58*a–b* on the opposing ends and opposing surfaces of the members to engage a hole or recess 62 in the bore 28. The spring 66 is located in a recess beneath the button such that when the end of the elongated member is inserted in the bore the button is forced downward, compressing the spring, and when the button is aligned with the hole or recess 62 the spring 66 forces the button into the hole or recess to lock the elongated member in position. The outer surface of the button is rounded to permit the button to be readily depressed by the inner wall of the bore during insertion of the elongated member into or removal of the elongated member from the bore.

Returning to FIG. 6 for ease of use, the longitudinal axis 51 of the handle 26 (and of the multi-purpose tool) can be substantially aligned with the longitudinal axis of the elongated member 50. In this manner, the user is not struggling with using a tool on the elongated member that is positioned off-center relative to the handle. The full extent of the force exerted by the user on the multi-purpose tool is thereby concentrated on the tool on the end of the elongated member. When the extension is engaged with an elongated member that is in turn engaged with the bore 28 in the handle 26, the hole or recess 62 in the handle and the hole or recess 88 in the extension are located on opposite sides of the tool 20.

Referring to FIGS. 9–12, a plurality of extensions 72*a–d* can be engaged with the free end 76 of the elongated member 50 that is projecting from the bore 28. The distal end 92 of the extension 72 can include a hexagonal socket (or nut driver) for loosening or tightening nuts and bolts. The socket can be in either metric or standard sizes.

Figure 9:
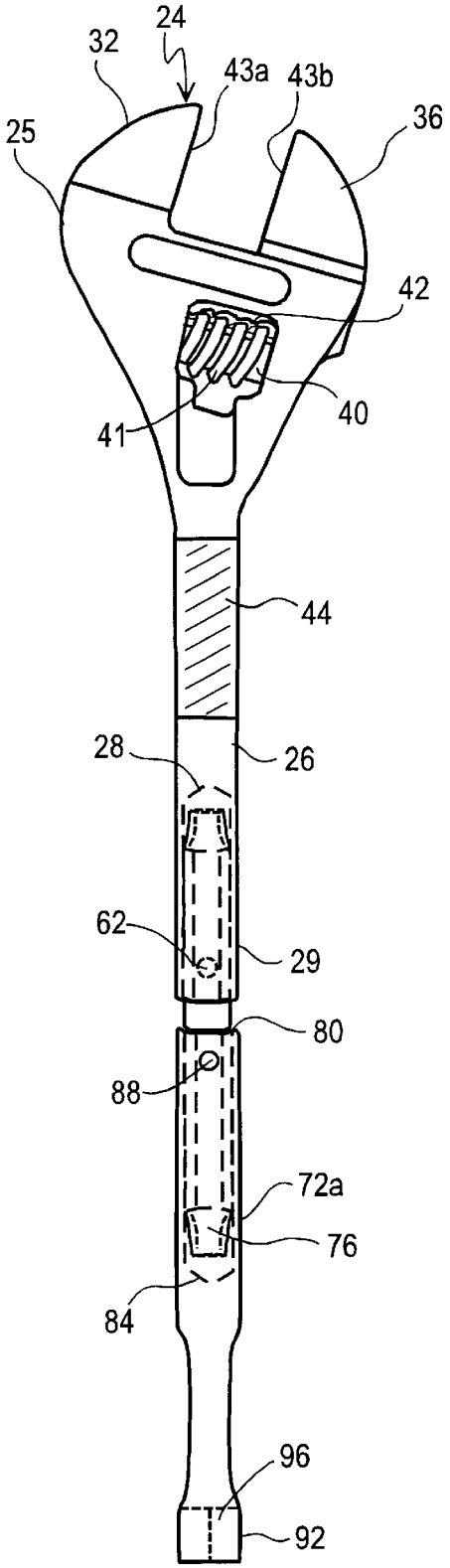
FIGS. 9–12 are top views of the adjustable crescent wrench attached to various extensions and elongated members.

Referring to FIG. 9, the proximal end 80 of each extension 72*a–d* includes a hollow bore 84 that is large enough to receive the free end 76 of the elongated member 50. A hole or recess 88 is located on an inner wall of the bore 84 to engage the button 58 on the free end 76 of the elongated member 50. As will be appreciated, a number of other configurations, such as a pair of wires, which interlock a groove on either side of the member 50 or a magnet in the handle, can be used to retain the member 50 in the bore 28 (or the bore 84). The bore 84 of the extension has the same shape as the bore 28 of the handle. Thus, if the bore 28 is hexagonal to receive a hexagonally shaped member 50, the bore 84 is also hexagonal. In that event, a hexagonal bore is located on one end of the extension and a hexagonal socket on the other end.

Figure 15:
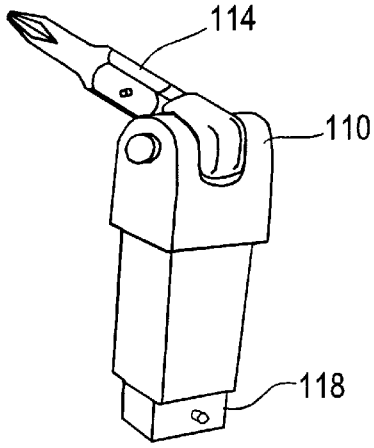
FIG. 15 is a side view of an adaptor.
Figure 10:
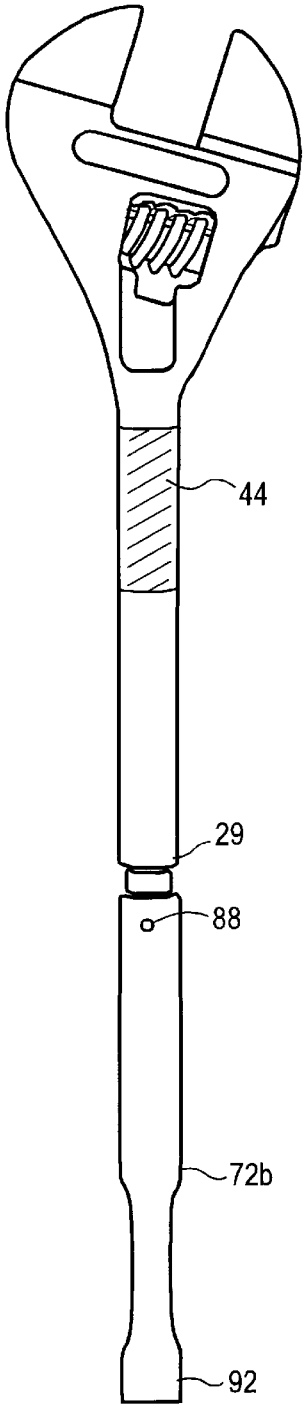
Figure 11:
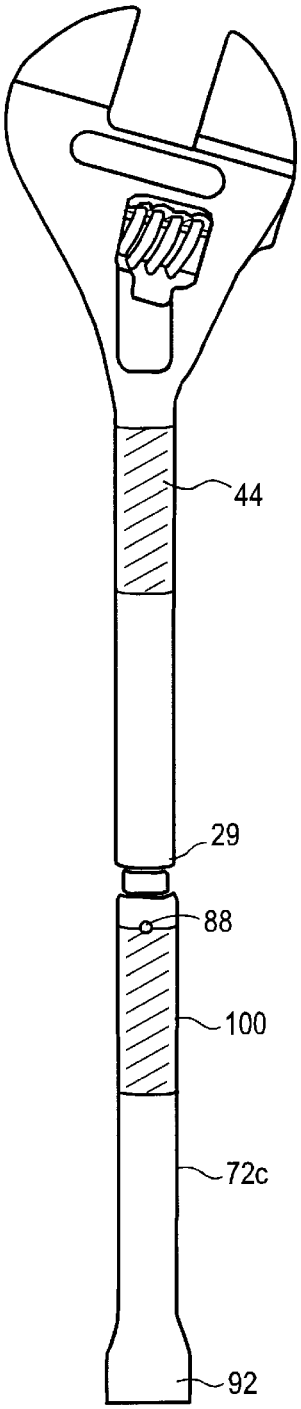
Figure 12:
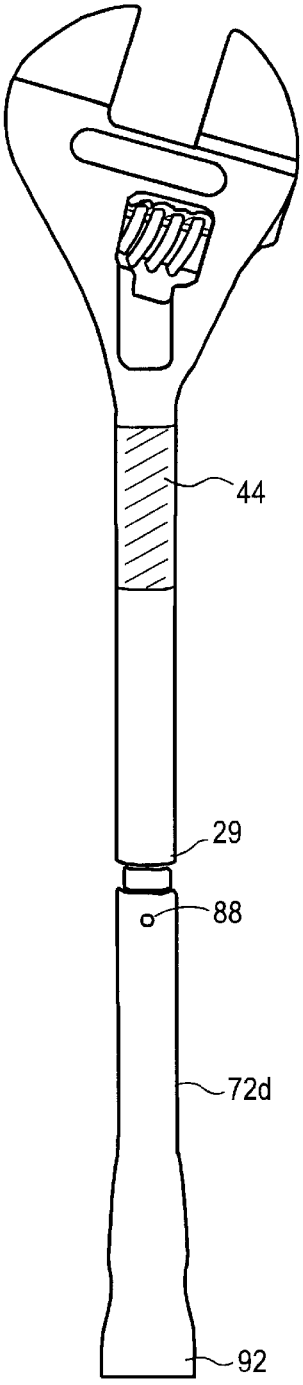

With reference to FIG. 15, an adaptor 110, which has an hexagonal extension 114 to match the configuration of the socket 96 and a rectangular extension 118 to engage a plurality of sockets of differing sizes, can be received in the socket 96 for added versatility. The adaptor can be hinged, such as with a universal joint, to permit either the hexagonal extension or the rectangular extension to rotate relative to one another.

Figure 13:
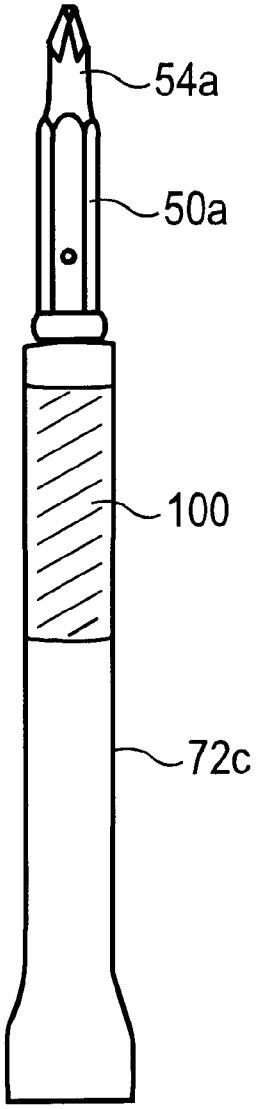
FIGS. 13–14 are top views of a knurled extension attached to different elongated members.
Figure 14:
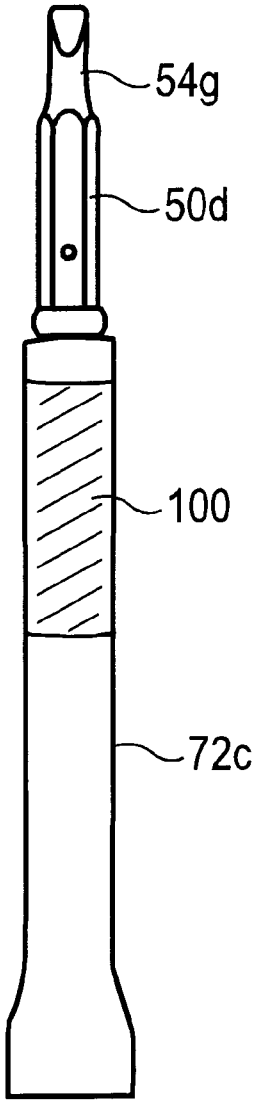

Referring to FIGS. 13–14, one of the extensions 72*c* can be removed from the handle and used independently as a tool. The extension 72*c* has a knurled section 100 for gripping by the user. The extension 72*c* has an elongated member 50 engaged in the bore that provides a tool on the free end of the elongated member for application by the user.

The above-described parts comprise a tool set that fits easily within a pocket-sized pouch. The set is not only highly versatile but also easily transportable by the user.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain the best mode known of practicing the invention and to enable others skilled in the art to utilize the invention, and such other embodiments, and with various modifications required by the particular applications or uses of the present invention. It is intended that the appended claims be construed to include alternative embodiments to the extent permitted by the prior art.

What is claimed is:

1. A compact multi-purpose hand tool, comprising:

an elongated member having a tool on each of the opposing ends thereof, each of the tools being at least one of a screwdriver and a hexagonal wrench; and a handle having (a) a distal end, the distal end having spaced-apart surfaces for gripping objects therebetween, (b) a proximal end, the proximal end having a hollow bore for removably engaging the elongated member, and (c) a longitudinal axis, the longitudinal axis being substantially in alignment with a longitudinal axis of the elongated member, wherein the elongated member comprises at least one button for engaging a recess in the bore, the button being movably mounted on the elongated member with a spring contacting a bottom end of the button and a rounded surface of the button projecting from a surface of the elongated member to engage the recess and wherein a button is located at each of the opposing ends of the elongated member.

2. The compact multi-purpose hand tool of claim 1, wherein the spaced-apart surfaces are substantially parallel to one another and at least one of the spaced-apart surfaces is movably mounted on the distal end of the handle to permit a distance between the spaced-apart surfaces to be varied.

3. The compact multi-purpose hand tool of claim 1, wherein the handle is substantially cylindrical in shape.

4. The compact multi-purpose hand tool of claim 1, wherein the bore in the handle engages a first portion of the elongated member and further comprising:

an extension having a bore for receiving a second portion of the elongated member, the first and second portions being located at opposing ends of the elongated member.

5. The compact multi-purpose hand tool of claim 4, wherein a proximal end of the extension is adjacent to the proximal end of the handle and wherein the extension has a tool located at a distal end of the extension.

6. The compact multi-purpose hand tool of claim 1, wherein at least one of the tools is a screwdriver and the screwdriver is one of a straight-blade head, a cross-head, and a six-pointed head.

7. A compact multi-purpose hand tool, comprising:

an elongated member;

a handle having proximal and distal ends, the proximal end having a bore for removably engaging a first portion of the elongated member and the distal end having opposing spaced-apart surfaces for gripping objects therebetween and an extension having a bore for removably engaging a second portion of the elongated member, the first and second portions being located at opposing ends of the elongated member, wherein the extension has a tool located at a distal end thereof and wherein the spaced-apart surfaces are substantially parallel to one another and at least one of the spaced-apart surfaces is movably mounted on the distal end of the handle to permit a distance between the spaced-apart surfaces to be varied.

8. The compact multi-purpose hand tool of claim 7, wherein the elongated member comprises a tool on each of the opposing ends thereof.

9. The compact multi-purpose hand tool of claim 8, wherein the tool is selected from the group consisting of a socket, a screwdriver, and a hexagonal wrench.

10. The compact multi-purpose hand tool of claim 7, wherein the handle has a longitudinal axis and the extension has a longitudinal axis and the longitudinal axes are substantially collinear.

11. The compact multi-purpose hand tool of claim 7, wherein the elongated member comprises at least one button for engaging a recess in the handle bore, the button being movably mounted on the elongated member with a spring contacting a bottom end of the button and a rounded surface of the button projecting from a surface of the elongated member to engage the recess.

12. The compact multi-purpose hand tool of claim 11, wherein a button is located at each of the opposing ends of the elongated member.

13. The compact multi-purpose hand tool of claim 12, wherein the extension bore has a second recess for engaging a button located on the second portion of the elongated member.

14. A compact multi-purpose hand tool, comprising:

an elongated member having a tool on each of the opposing ends thereof, each of the tools being at least one of a screwdriver and a hexagonal wrench;

a handle having (a) a distal end, the distal end having spaced-apart surfaces for gripping objects therebetween, (b) a proximal end, the proximal end having a hollow bore for removably engaging the elongated member, and (c) a longitudinal axis, the longitudinal axis being substantially in alignment with a longitudinal axis of the elongated member, wherein the bore in the handle engages a first portion of the elongated member; and an extension having a bore for receiving a second portion of the elongated member, the first and second portions being located at opposing ends of the elongated member and wherein a proximal end of the extension is adjacent to the proximal end of the handle and wherein the extension has a tool located at a distal end of the extension.

15. The compact multi-purpose hand tool of claim 14, wherein the spaced-apart surfaces are substantially parallel to one another and at least one of the spaced-apart surfaces is movably mounted on the distal end of the handle to permit a distance between the spaced-apart surfaces to be varied.

16. The compact multi-purpose hand tool of claim 14, wherein the handle is substantially cylindrical in shape.

17. The compact multi-purpose hand tool of claim 14, wherein at least one of the tools is a screwdriver and the screwdriver is one of a straight-blade head, a crosshead, and a six-pointed head.

18. A compact multi-purpose hand tool, comprising:

an elongated member;

a handle having proximal and distal ends, the proximal end having a bore for removably engaging a first portion of the elongated member and the distal end having opposing spaced-apart surfaces for gripping objects therebetween and an extension having a bore for removably engaging a second portion of the elongated member, the first and second portions being located at opposing ends of the elongated member, wherein the extension has a tool located at a distal end thereof, wherein the elongated member comprises at least one button for engaging a recess in the handle bore, the button being movably mounted on the elongated member with a spring contacting a bottom end of the button and a rounded surface of the button projecting from a surface of the elongated member to engage the recess, and wherein a button is located at each of the opposing ends of the elongated member.

19. The compact multi-purpose hand tool of claim 18, wherein the extension bore has a second recess for engaging a button located on the second portion of the elongated member.

* * * * *